US012221261B2

(12) United States Patent
Piejko-Brown et al.

(10) Patent No.: US 12,221,261 B2
(45) Date of Patent: Feb. 11, 2025

(54) PACKAGE WITH PRODUCT LOCKING ASSEMBLY

(71) Applicant: HASBRO, INC., Pawtucket, RI (US)

(72) Inventors: Andrew James Piejko-Brown, Providence, RI (US); Ryan Thomas Wilson, Clover, SC (US); Yui Him Ludwig Leung, North Point (HK)

(73) Assignee: HASBRO, INC., Pawtucket, RI (US)

( * ) Notice: Subject to any disclaimer, the term of this patent is extended or adjusted under 35 U.S.C. 154(b) by 81 days.

(21) Appl. No.: 17/926,922

(22) PCT Filed: May 21, 2021

(86) PCT No.: PCT/US2021/033522

§ 371 (c)(1),
(2) Date: Nov. 21, 2022

(87) PCT Pub. No.: WO2021/237003

PCT Pub. Date: Nov. 25, 2021

(65) Prior Publication Data

US 2023/0234764 A1 Jul. 27, 2023

Related U.S. Application Data

(60) Provisional application No. 63/028,270, filed on May 21, 2020.

(51) Int. Cl.
*B65D 73/00* (2006.01)

(52) U.S. Cl.
CPC ..... *B65D 73/0014* (2013.01)

(58) Field of Classification Search
CPC ..... B65D 73/005; B65D 73/0014; A47F 2007/0092; A47F 5/0084
See application file for complete search history.

(56) References Cited

U.S. PATENT DOCUMENTS 3,674,138 A * 7/1972 Gilmour ..... B65D 73/0014 206/349
4,311,236 A * 1/1982 Johnson ..... B65D 73/0042 206/488

(Continued)

FOREIGN PATENT DOCUMENTS

| | | |
|---|---|---|
| DE | 20001800 U1 | 3/2000 |
| GB | 2425105 A | 10/2006 |
| JP | S56138510 A | 10/1981 |

OTHER PUBLICATIONS

International Search Report and Written Opinion for Corresponding International Application No. PCT/US2021/033522 mailing date Aug. 13, 2021.

*Primary Examiner* — Mollie Impink
(74) *Attorney, Agent, or Firm* — MARSHALL, GERSTEIN & BORUN LLP

(57) ABSTRACT

A package having a product locking feature can include a product display panel to which a product is secured with a product locking assembly. The product locking assembly can include a locking element and a receiving element, the locking element being one-way insertable into the receiving element in two stages, the first stage being for securing the product display panel to the product and the second stage being further insertion of the locking element into the receiving element after the product is removed from the product display panel.

26 Claims, 15 Drawing Sheets

(56) References Cited

U.S. PATENT DOCUMENTS

| | | | | | |
|---|---|---|---|---|---|
| 4,407,413 | A * | 10/1983 | Jansson | F16B 5/065 | D8/388 |
| 4,682,690 | A * | 7/1987 | Tiffany | B65D 5/5028 | 206/493 |
| 5,782,090 | A * | 7/1998 | Locke | F16L 3/127 | 248/74.2 |
| 6,283,311 | B1 | 9/2001 | Lee | | |
| 7,377,390 | B2 * | 5/2008 | Modesto | A47F 7/00 | 206/464 |
| 7,789,235 | B2 * | 9/2010 | Trapp | B65D 73/0014 | 206/495 |
| 8,353,397 | B2 * | 1/2013 | Trapp | B65D 73/0014 | 206/480 |
| 8,657,116 | B2 * | 2/2014 | Buresch | B65D 73/0014 | 206/478 |
| 2011/0253579 | A1 * | 10/2011 | Chong | B65D 73/0014 | 29/525.01 |

* cited by examiner

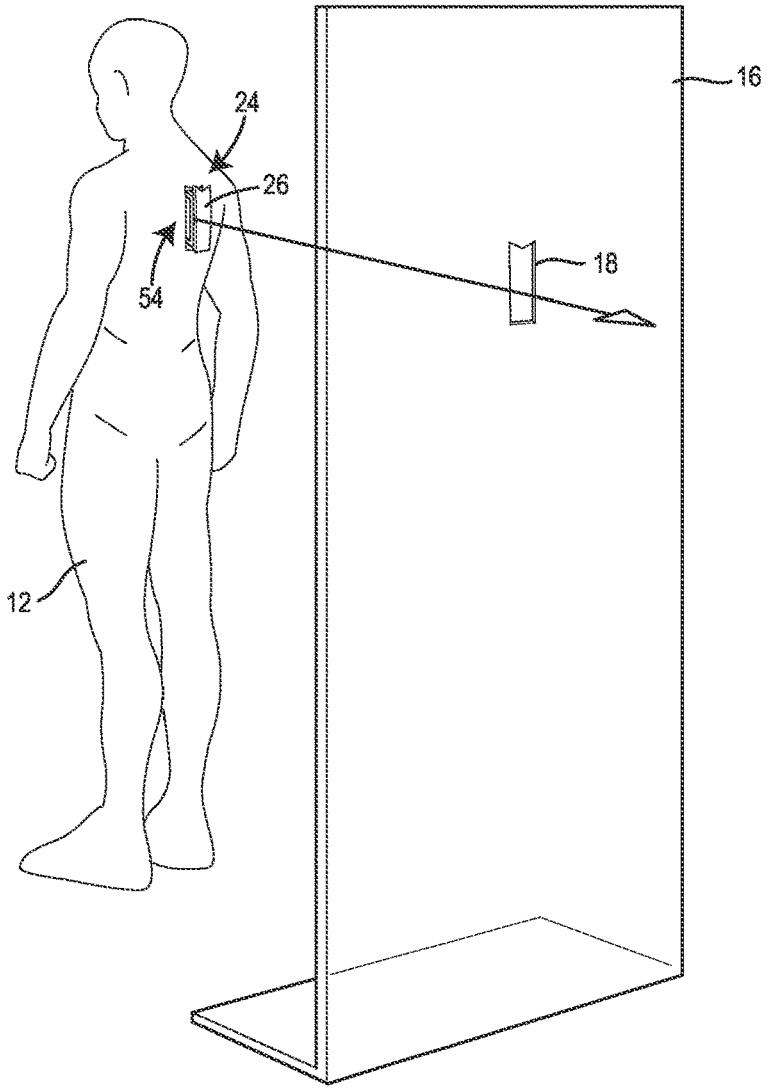
FIGURE 7
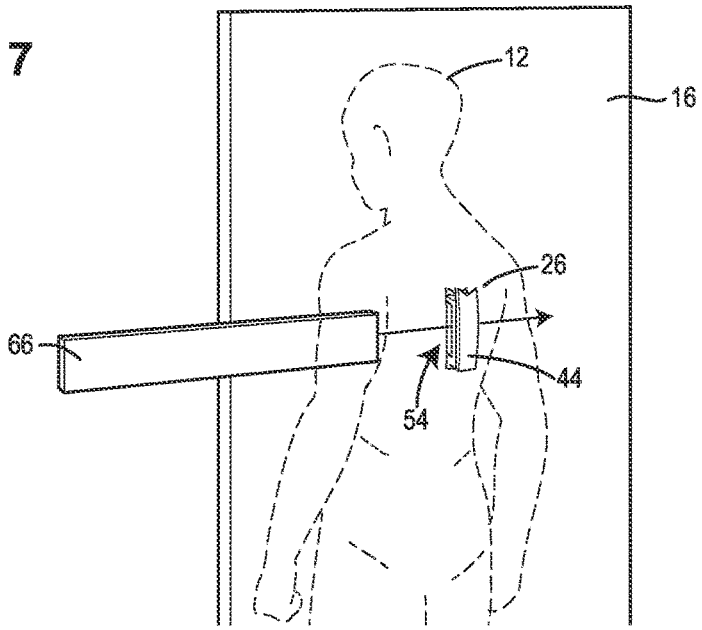

PACKAGE WITH PRODUCT LOCKING ASSEMBLY

CROSS-REFERENCE TO RELATED APPLICATION

This patent application is a U.S. national phase of International Patent Application No. PCT/US2021/033522 filed on May 21, 2021, which claims the benefit of priority to U.S. Provisional Patent Application No. 63/028,270 filed May 21, 2020, the respective disclosures of which are each incorporated herein by reference in its their entireties.

BACKGROUND

Field of the Disclosure

The disclosure relates to a product locking assembly and packages having product locking assemblies for securing a product to a package display panel of a package.

Brief Description of Related Technology

Packaging fasteners are used in a variety of fields to help retain products within packaging, secure products for display within packaging, prevent theft of the product from within the package, and/or provide evidence of tampering. Such locking fasteners can be used with a variety of product types, and are commonly used in toy packaging. Examples of prior packaging fasteners include zip ties, wire-tie fasteners, paper-string fasteners, and molded plastic fasteners that are turned to alignment with an aperture within the product for removal. Such conventional fasteners can be difficult to remove, making opening of the package frustrating, which can be detrimental to the consumer's overall impression and satisfaction with the product. Such fasteners can also be environmentally detrimental causing additional waste with the package.

SUMMARY

The technical information set out below may in some respects go beyond the disclosure of the invention, which is defined exclusively by the appended claims. The additional technical information is provided to place the actual invention in a broader technical context and to illustrate possible related technical developments. Such additional technical information which does not fall within the scope of the appended claims, is not part of the invention.

A package can include a product display panel to which a product is to be secured, the product display panel comprising an opening for receiving a product locking assembly. The product locking assembly can include a locking element having a peg and an extended portion extending from the peg, and the extended portion comprising first and second spaced apart projections, and a receiving element disposed in or attached to the product, the receiving element comprising an aperture having a first end and an inwardly disposed second end. The locking element is adapted to fit through the opening and be inserted into the receiving element to a first position such that product display panel is secured to the product and the first projection extends past the second end of the aperture of the receiving element to prevent the locking element from being removed from the aperture, and the locking element being further adapted to be further inserted into the aperture after removal of the product display panel from the product to a second position such that the second projection extends past the second end of the aperture of the receiving element.

The base can be a locking peg having a size such that the locking peg does not fit through the opening, a portion of the product display panel is positioned between the locking peg and the product when the locking element is in the first position and prevents the locking element from being further inserted to the second position, and the product display panel is removed from between the locking peg and the product by tearing the product display panel to enlarge the opening such that the product display panel can be removed around the locking peg, thereby allowing the locking element to be further inserted to the second position.

The product locking assembly can further comprise a packaging lock, wherein the locking element further includes a packaging lock receiving aperture adapted to receive a packaging lock when the locking element is inserted into the receiving element to the first position, the packaging lock being adapted to prevent the locking element from being inserted into the receiving element to the second position when disposed in the packaging lock receiving aperture, the locking element being adapted to fit through the opening of the product display panel when the packaging lock is removed from the packaging lock receiving aperture to allow for removal of the product display panel from the product and further insertion of the locking element to the second position.

A package can include a product display panel to which a product is secured, the product display panel comprising an opening for receiving a product locking assembly. The product locking assembly can include a locking element having a peg and an extended portion extended outwardly from the peg from a first end to an oppositely disposed second end, the extended portion having a first projection disposed at or adjacent to the second end and a second projection disposed along a length of the extended portion between the first projection and the first end; and a receiving element disposed in the product, the receiving element having an aperture that extends from a first end at a product exterior surface to a second end in an interior of the product, the aperture can have a diameter at the second end that is smaller than a diameter at the first end. The extended portion is adapted to reversibly deform from a first diameter to a second diameter such that the extended portion is in a deformed state can be inserted through the end of the aperture, and after insertion through the second end of the aperture expand back to the first diameter. The locking element is adapted to be non-reversibly inserted into the receiving element to a first position to secure the product to the package display panel, wherein in the first position the first projection extends through the second end of the aperture and prevents the locking element from being removed from the receiving element. The locking element is adapted to be further inserted into the aperture of the receiving element to a second position after removal of the product from the product display panel wherein in the second portion the second projection extends past the second end of the aperture.

The peg can be a locking peg having a size such that the locking peg does not fit through the opening, a portion of the product display panel is positioned between the locking peg and the product when the locking element is in the first position and prevents the locking element from being further inserted to the second position, and the product display panel is removed from between the locking peg and the product by tearing the product display panel to enlarge the opening such that the product display panel can be removed around the locking peg, thereby allowing the locking element to be further inserted to the second position.

The product locking assembly further comprises a packaging lock, wherein the locking element further includes a packaging lock receiving aperture adapted to receive a packaging lock when the locking element is inserted into the receiving element to the first position, the packaging lock being adapted to prevent the locking element from being inserted into the receiving element to the second position when disposed in the packaging lock receiving aperture, the locking element being adapted to fit through the opening of the product display panel when the packaging lock is removed from the packaging lock receiving aperture to allow for removal of the product display panel from the product and further insertion of the locking element to the second position.

BRIEF DESCRIPTION OF THE DRAWINGS

FIG. 7 is schematic illustration of the package locking assembly of FIG. 5, showing how a product is secured to a package using the packaging lock;

DETAILED DESCRIPTION

Figure 1:
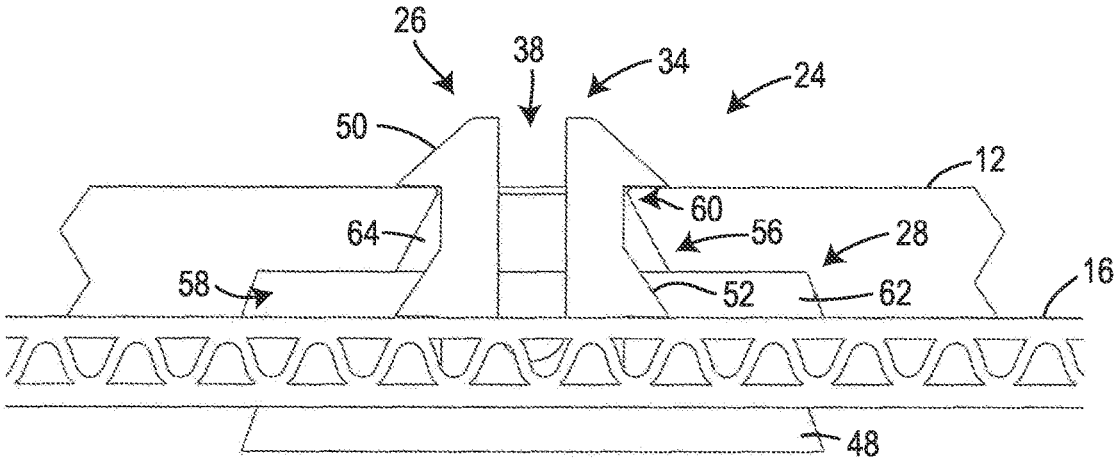
FIG. 1 is a cross-sectional side view of a package having a locking assembly in accordance with the disclosure, the locking assembly being in a first position.

The technical information set out below may in some respects go beyond the disclosure of the invention, which is defined exclusively by the appended claims. The additional technical information is provided to place the actual invention in a broader technical context and to illustrate possible related technical developments. Such additional technical information which does not fall within the scope of the appended claims, is not part of the invention.

A package of the disclosure can include a product display panel to which a product is to be secured, the product display panel comprising at least one opening for receiving a product locking assembly. The product locking assembly can include a locking element comprising a base and an extended portion extending from the base and at least one projection extending outwardly from the extended portion, and a receiving element disposed in, formed in, and/or attached to the product, the receiving element comprising an aperture having a first end and an inwardly disposed second end. The extended portion of the locking element is adapted to fit through the opening in the product display panel and be inserted into the receiving element to a first position such that the product display panel is secured to the product and the at least one projection engages with a first retaining structure of the receiving element such that the locking element cannot be withdrawn from the receiving element. The locking element is adapted to be further inserted into the aperture after removal of the product display panel from the product to a second position. In the second position, product locking assembly can be adapted such that a second projection or set of projections on the extended portion engages with the first retaining structure. Alternatively, in the second position, the packaging locking assembly can be adapted such that the extend portion includes only one or a single set of projections that interact with a second retaining structure of the receiving element.

A package of the disclosure can include a product display panel to which a product is secured. While the term product display panel is used herein, it should be understood that the product need not be displayed within the package and could be entirely covered by additional exterior packaging elements. Further, it should be understood herein that any panel of a package whether part of an interior structure, a standalone panel, or part of an exterior structure of the packaging can be the product display panel as the term is used herein so long as the product is secured to such surface or panel of the packaging. In various embodiments, the product display panel is further contained within an exterior package, such as a cardboard box type package or other exterior package. The exterior package can have, for example, a plastic display panel or display opening. Any type of outer packaging can be used with locking assemblies disclosed herein. The product display panel can be a portion of the outer packaging. Alternatively, the product display panel can be entirely contained within an outer package.

The product locking assembly of the disclosure can advantageously secure the product to or within the package to aid in display of the product and/or prevent theft of the product when on a store shelf, yet allow for easy removal of the product during opening. Further, the product locking assemblies of the disclosure can be more environmentally friendly than conventional package fasteners, reducing waste.

Figure 5:
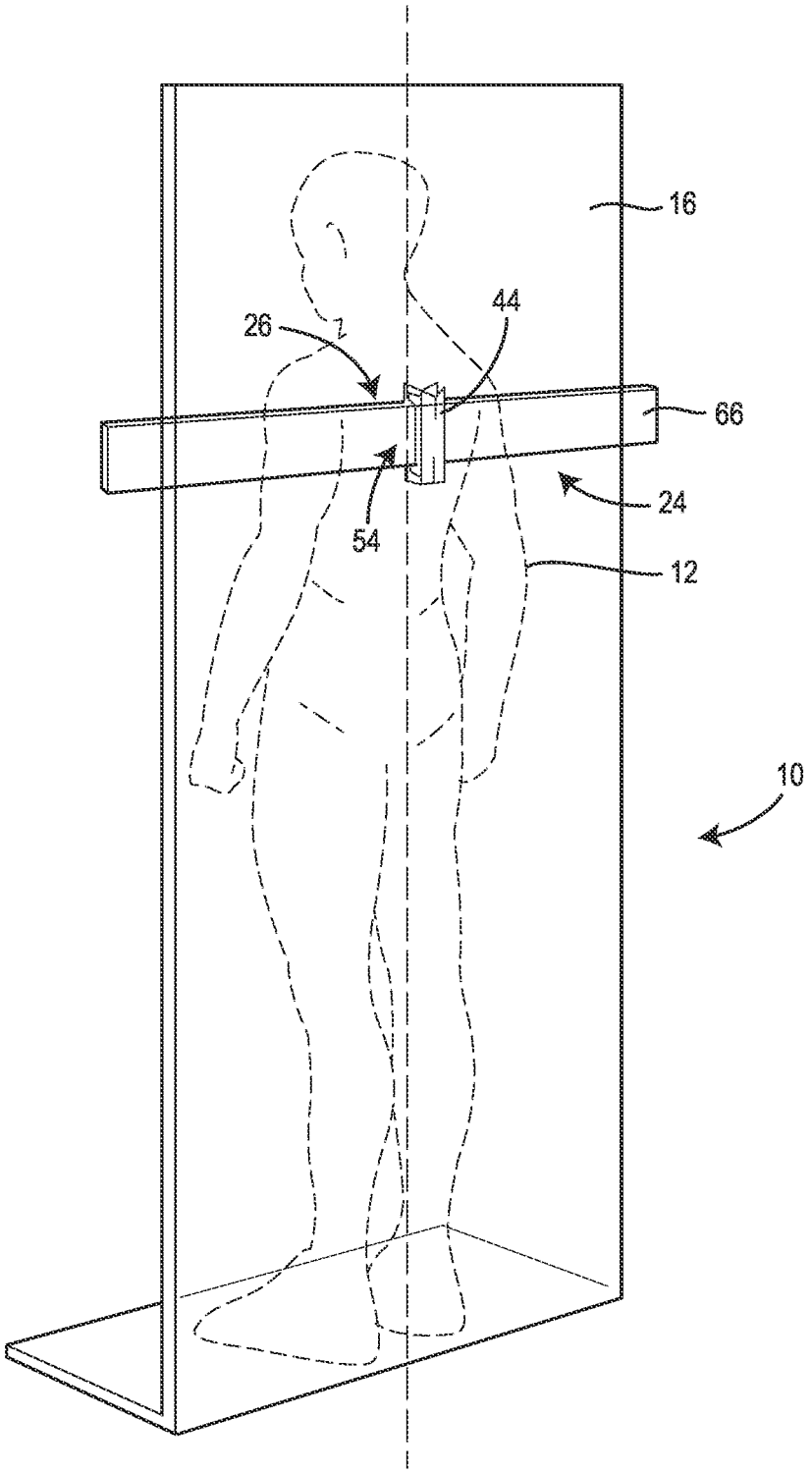
FIG. 5 is a schematic illustration of installation and removal of a product from a package having a locking assembly in accordance with the disclosure.
Figure 6:
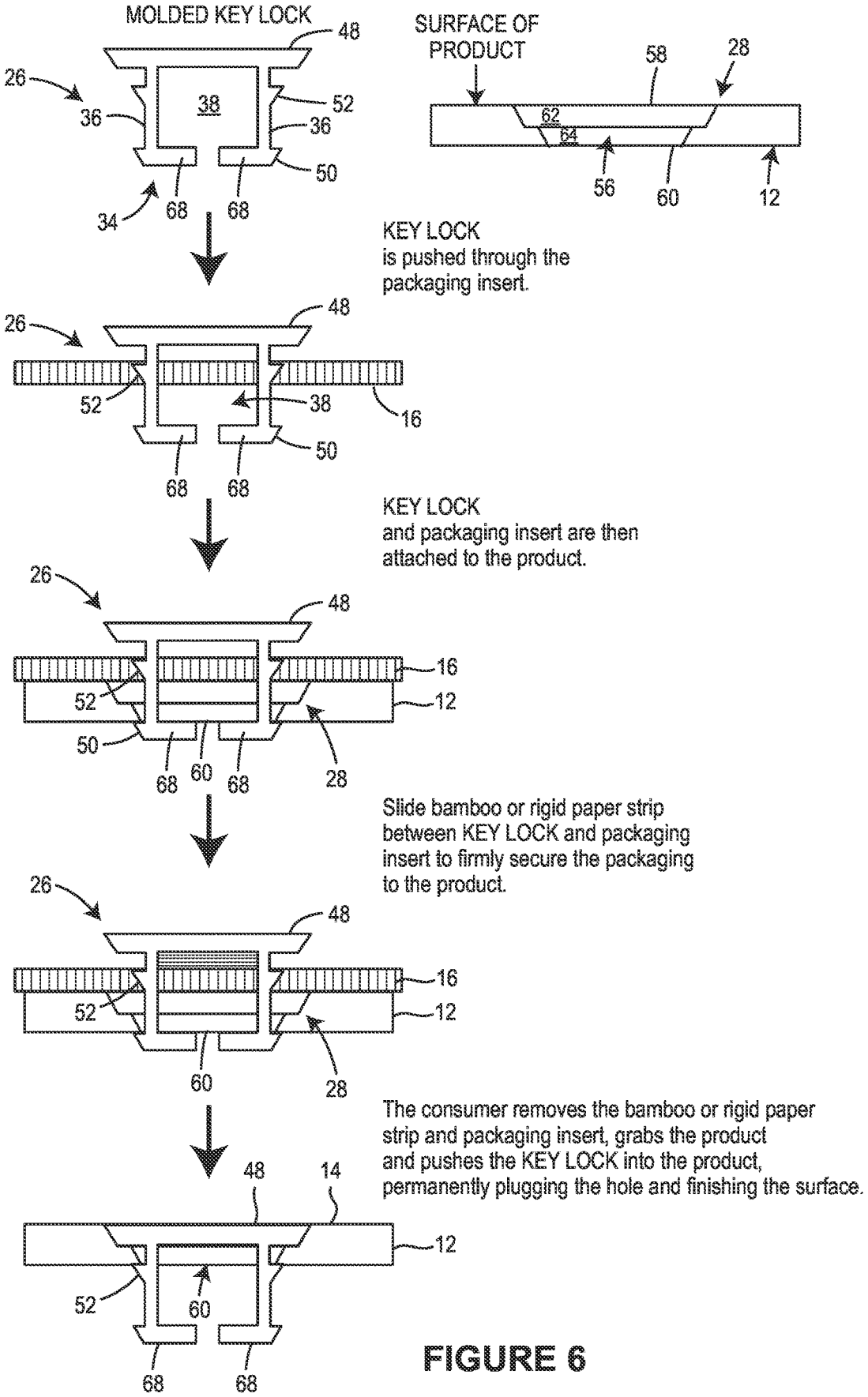
FIG. 6 is a flow chart showing the package locking assembly of FIG. 5 securing a product to a product display panel using a packaging lock.
Figure 11:
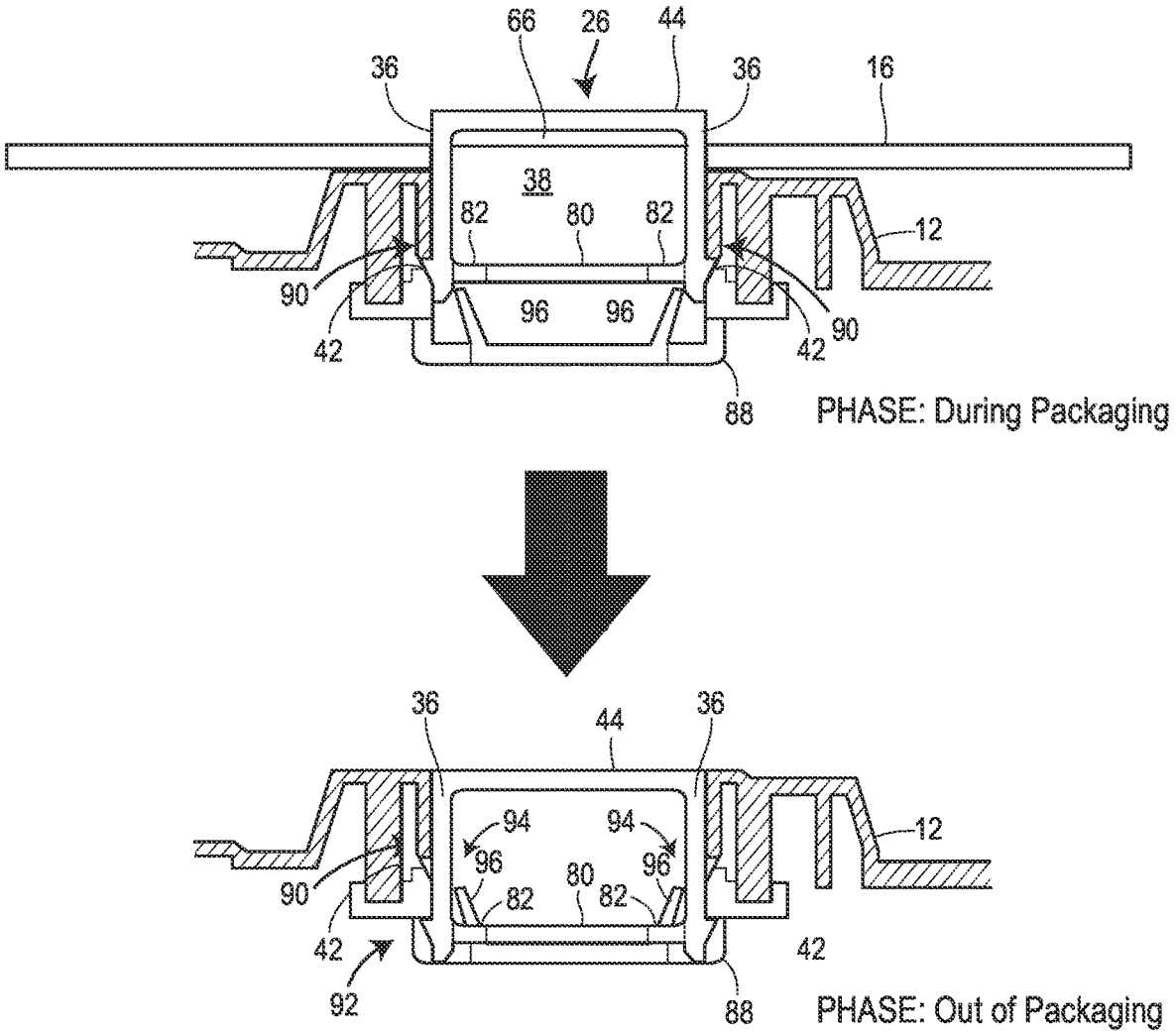
FIG. 11 is a schematic illustration of a packaging locking assembly in accordance with the disclosure shown in the first and second positions.
Figure 12:
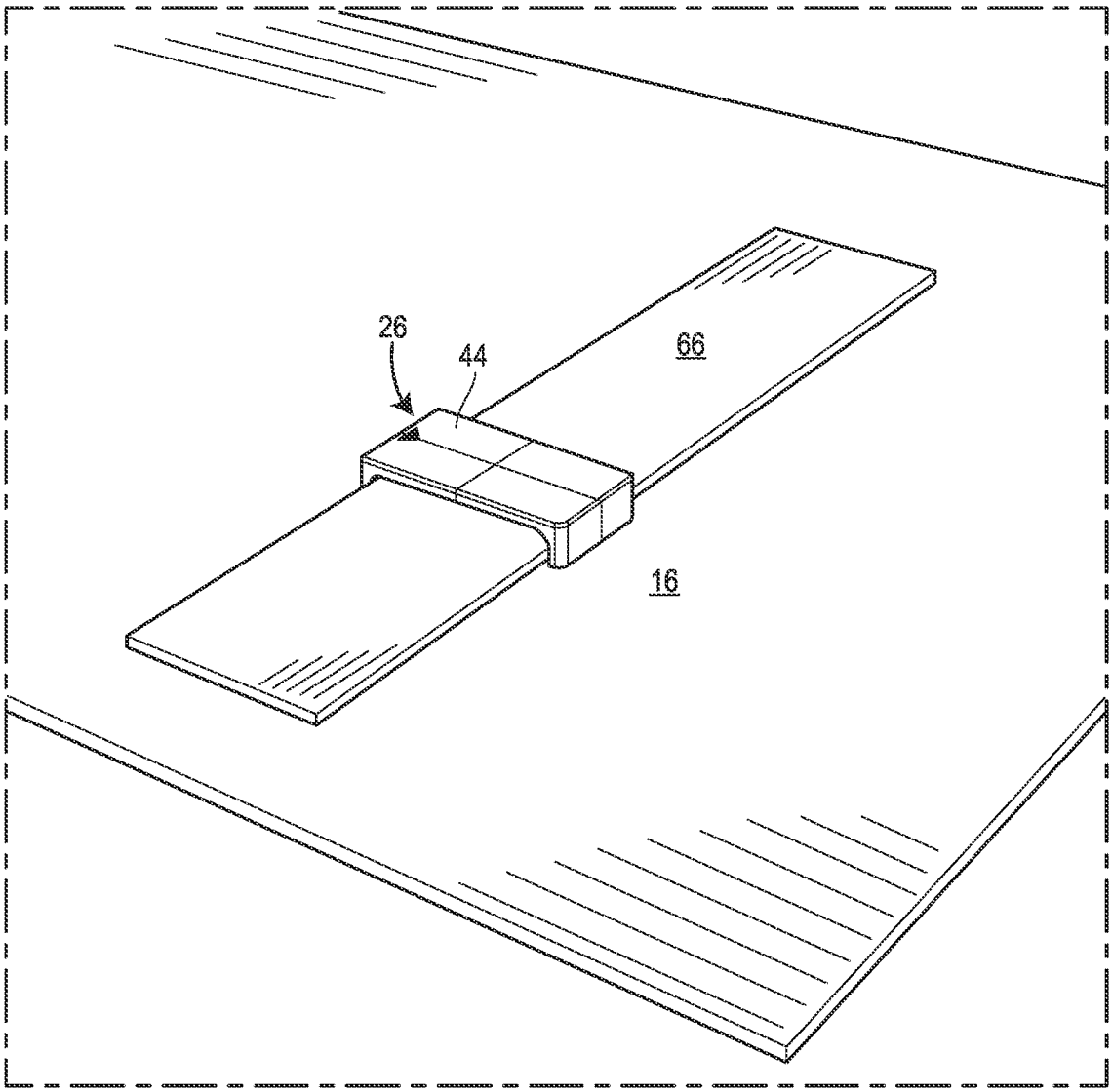
FIG. 12 is a schematic illustration showing a packaging locking assembly having a packaging lock in accordance with the disclosure.
Figure 13A:
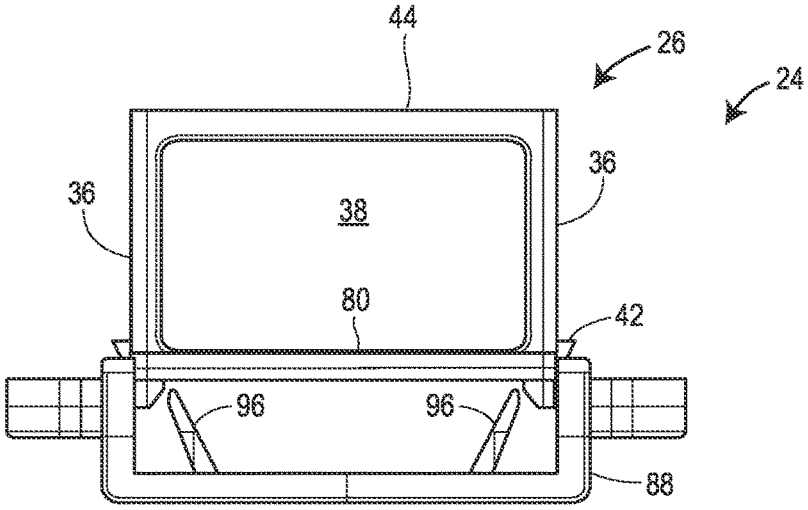
FIGS. 13A to 13C are views of a packaging locking assembly having a receiving element retainer in accordance with the disclosure, showing the locking element in the first position.
Figure 13B:
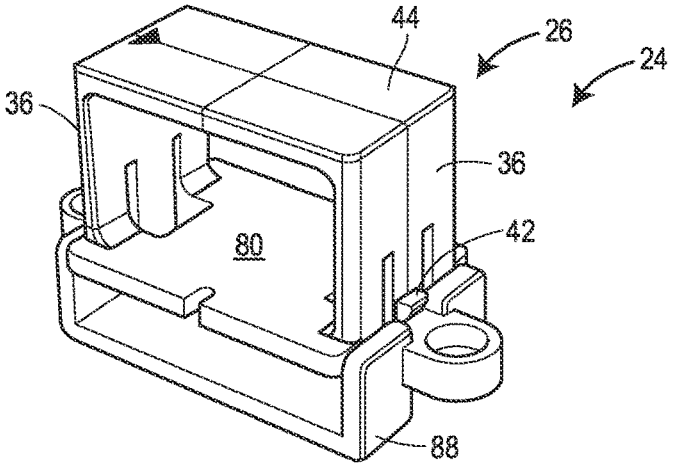
Figure 13C:
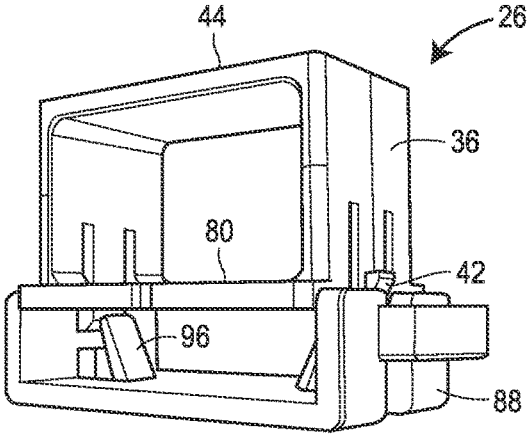

Referring to FIG. 1, a package 10 can include a product display panel 16 and a product locking assembly 24. FIGS. 5, 6, and 12 illustrates a package 10 with a product locking assembly that further includes a packaging lock 66. FIG. 11 illustrates a product locking assembly that includes a retaining receiving element having additional retaining structures to engage with a locking element of the product locking assembly.

The package display panel 16 is secured to the product 12 using the locking assembly 24 of the disclosure. The locking assembly 24 includes a locking element 26 and a receiving element 28. The locking element 26 is designed for one-way insertion into the receiving element 28 in two stages. That is, once inserted, the locking element 26 cannot be removed from the receiving element 28. Further, once inserted from the first stage to the second stage, the locking element 26 cannot be returned to the first stage position. In the first stage or first position, the locking element 26 is inserted into the receiving element 28 to secure the product 12 to the product display panel 16. In various embodiments, product locking assembly 24 can further include a packaging lock 66 for securing the product 12 to the product display panel 16. In the second stage or second position, the locking element 26 is further inserted into the receiving element 28 after removal of the product 12 from the product display panel 16. The receiving element 28 can be formed into the product and/or include structures inserted within the product 12. In such arrangements of the receiving element 28, when in the second position, the locking element 26 can become in line with and a part of the exterior surface 14 of the product 12. The product locking assembly 24 can be designed, for example, such that locking element 26 becomes part of the product 12 when in the second position and can be largely unnoticeable to a user when in the second position so as not to disrupt or harm the aesthetic look of the product 12, for example, as illustrated in FIG. 15

The product display panel 16 includes an opening 18 that is arranged to align with the receiving element 28. The opening 18 is sized such that at least a portion of the locking element 26 can extend through the opening 18 to engage the receiving element 28. As described in detail below, the opening 18 can be sized such that once inserted, the locking element 26 cannot be removed through the opening 18 without causing damage to the product display panel 16. In other configurations, such as those using a packaging lock 66, the opening 18 can be size to allow the locking element 26 to pass freely into and out of the opening 18.

Figure 3:
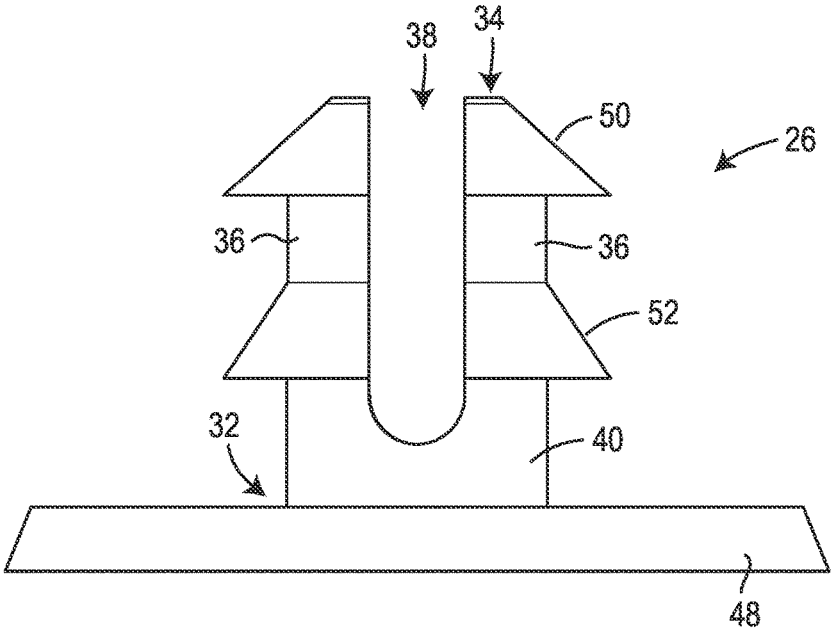
FIG. 3 is a side view of a locking element of a locking assembly in accordance with the disclosure.

The locking element 26 includes an extended portion 30 that extends from a base 44. FIG. 3 illustrates an embodiment of the locking element 26 in which an extended portion 30 extends from a base that is in the form of a locking peg head 48, the locking peg head 48 being sized to prevent the locking element from passing through the opening 18 without causing damage to the product display panel 16. FIGS. 5 and 11 illustrates a locking element in which the extended portion 30 extends as two arms 36 from the base 44 of the locking element 26. The arrangement of the extended portion 30 can be tailored to the receiving element 28 to which it is to be inserted. The receiving element 28 size and shape can be tailored to the product to which it is disposed in or on.

Referring to FIGS. 3 and 5, the extended portion 30 of the locking element 26 has a length extending from a first end 32 adjacent to the base 44 to a second end 34. The second end 34 is the portion of the extended portion 30 that is first inserted into the receiving element 28. In embodiments, such as shown in FIG. 3, the second end 34 of the extended portion 30 can be tapered. This can allow for easier insertion into the receiving element 28 in various configurations.

The extended portion 30 includes at least a first projection 50. In some configurations, the extended portion can include first and second projections 50, 52. The projections extend outwardly from the extended portion 30 such that they can engage the wall surrounding an aperture in the receiving element 28 or engage with a retaining structure within the receiving element 28 to prevent the locking element 26 from being removed from the receiving element 28 after insertion to the first stage and to subsequently to the second stage. In embodiments, the projections 50, 52 can extend around an entire circumference of the extended portion 30. In other embodiments, such as where the extended portion 30 includes a gap 38 as detailed below, the projections can be provided as one or more sets of projections, each projection can extend from opposed sides of the gap.

Referring to FIG. 3, in locking elements 26 having first and second projections 50, 52, the first projection 50 can be disposed at or adjacent to the second end 34 of the extended portion 30. For example, FIG. 3 illustrates an embodiment in which the first projection 50 is disposed at the second end 34 of the extended portion 30. The second projection 52 is disposed along the length of the extended portion 30 between the first end 32 and the first projection 50. The first and/or second projections 50, 52 can be tapered with increasing diameter from the second end to the first end. The taper can aid in insertion of the extended portion 30 into the receiving element 28. For example, the projections 50, 52 can be formed of a reversibly deformable material and the taper can be used to guide deformation of the projections 50, 52 to a reduced diameter for insertion into the receiving element 28. For example, the first and second projections 50, 52 can have a frustoconical shape. In locking elements in which the extended portion includes a gap 38, the projections 50, 52 can include portions that extend on opposed sides of the gap 38. For example, each of the portions can have a half-frustoconical shape.

Referring to FIG. 11, the extended portion 30 can include a single projection or a single set of projection. In the example illustrated in FIG. 11, the locking element includes two extended portions 30 provided as two arms 36, extending a length between the base 44 and the second end 24. The projections can be at or adjacent to the second end 24 of each arm. The projections can be similarly tapered as described above. For example, as illustrated in FIG. 11, the projection 52 can be tapered such that when pressed into the receiving element 28 to the first position, the locking element 26 can be disposed such that the projection 52 is received in a spacing beneath an internal structure of the product and/or a retaining structure of the receiving element (referred to collectively herein as a first retaining structure). If the locking element 26 is attempted to be withdrawn from the first position, the projection interacts with the first retaining structure 90, for example by abutting up against the first retaining structure 90 to prevent the locking element 26 from being withdrawn.

Referring to FIG. 12B, the locking element can alternatively include a connecting wall 80 that joins the two arms 36. There can remain a gap 38 between the two arms 36, such that an internal opening is present in the locking element 26. The wall 80 can includes openings or apertures 82 for receiving one or more locking extensions 84 of the receiving element 28 that can aid in resisting removal of the locking element 26 from the receiving element 28 when it is in the second position.

Referring to FIG. 3, the extended portion 30 can be provided as two arms 36 extending from a shaft 40. A gap 38 can be disposed between the two arms 36, extending along a length of the extended portion 30. The gap 38 can be arranged such that the two arms 36 are not connected at any point, which can allow the extended portion 30 to reversibly deform from a first diameter, as measured around a projection 50, 52, and including any gap there between, to a second, smaller diameter to allow for inserting into the receiving element 28 while the extended portion 30 is in the deformed state and a return to the original, first diameter after insertion into the receiving element 28 to retain the locking element 26 in the receiving element 28. In the deformed state, the width of at least a portion of the gap 38 is reduced, as the arms are moved closer together during insertion the receiving element 28. In embodiments, the extended portion 30 can be in the deformed state during insertion into the opening 18 of the product display panel 12.

Referring to FIG. 5, as noted above, the extended portion 30 can be provided as two arms 36 that extend directly from the base 44 of the extended portion 30 without having a shaft 40 as in the embodiment of FIG. 3. In FIG. 5, the arms 36 are still separated by a gap 38 such that the no portion of the arms 36 are connected to one another. The extended portion 30 can reversible deform from a first diameter to a second, smaller diameter to allow for insertion into the receiving element 28 and can then return to the original first diameter after insertion. In such a deformed state, the arms 36 at least near the second end 34 of the extended portion 30 can be moved inward towards each other, reducing the width of the gap 38. In the embodiment illustrated in FIG. 5, the extended portion 30 can further include two inward projections at the second end 34, which extend from the second end 34 of each arm 36 into the gap 38. The two inward projections 68 can add stability to the arms 36 during insertion into the receiving element 28.

Referring to FIGS. 6 and 11, in embodiments in which the locking assembly includes a packaging lock 66, the locking element 26 can include a packaging lock receiving aperture 54. The packaging lock receiving aperture 54 can be arranged in the locking element 26 to allow for the packaging lock 66 to be inserted to prevent the locking element from being inserted further into the receiving element 28, as described in detail below. For example, in the locking element 26 illustrated in FIGS. 11 and 12, the opening can serve as the packaging lock receiving aperture 54. In embodiments, such as illustrated in FIG. 6, the packaging lock receiving aperture 54 can be disposed below the base 44. For example, the packaging lock receiving aperture 54 can be immediately below the base 44. Referring to FIGS. 5 and 11, the packaging lock receiving aperture 54 can be defined in the gap 38 between two arms 36 of an extended portion immediately below the base 44. In other embodiments, for example, in which the extended portion 30 does not include a gap 38, the packaging lock receiving aperture 54 can be formed by an aperture disposed through the extended portion 30. In embodiments, the packaging lock receiving aperture 54 can be formed by an aperture disposed through the base 44.

The packaging lock 66 is sized to fit into the packaging lock receiving aperture 54, which can be the gap 38, and remain retained in the packaging lock receiving aperture 54 until actively pulled for removal by the consumer during opening. That is, the packaging lock 66 is designed to fit within the packaging lock receiving aperture 54 with sufficient tightness that shaking, rotating, compression, or other movements of the package such as during shipping, stocking on shelves, and viewing by consumers on shelf, will not displace the packaging lock 66.

The packaging lock 66 can be formed by a semi-rigid or rigid material. For example, a semi-rigid cardboard can be used. The packaging lock 66 needs sufficient rigidity, for example, to prevent the locking element 26 from being pressed into the receiving element 28 to the second position during compression of the package, which can occur for example during shipping or other manipulations of the package prior to opening. In embodiments, the packaging lock can be formed of the same material as the product display panel 16. In other embodiments, the packaging lock 66 can be formed from bamboo, or other wood product. Forming of the packaging lock 66 of a paperboard or wood product can advantageously make the packaging lock a recyclable element and avoid the need for additional plastics in the packaging. However, other materials, such as plastics are also contemplated herein.

Figure 4:
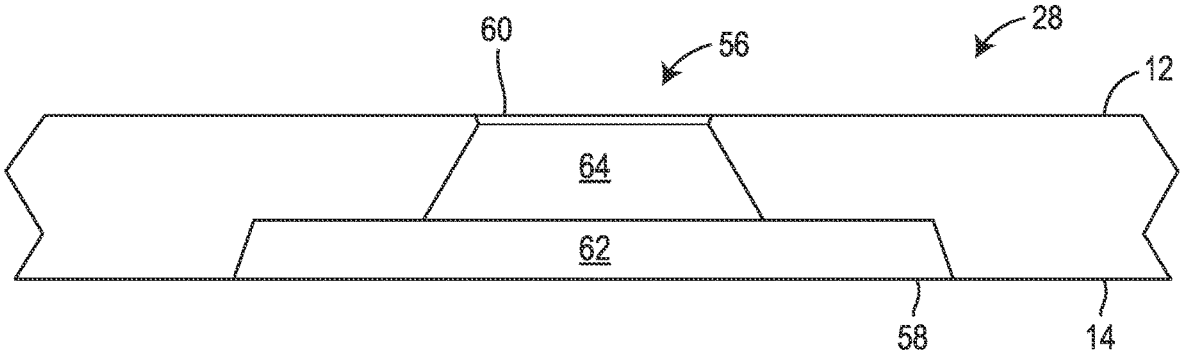
FIG. 4 is a cross-sectional side view of a receiving element of a locking assembly in accordance the disclosure.
Figure 14:
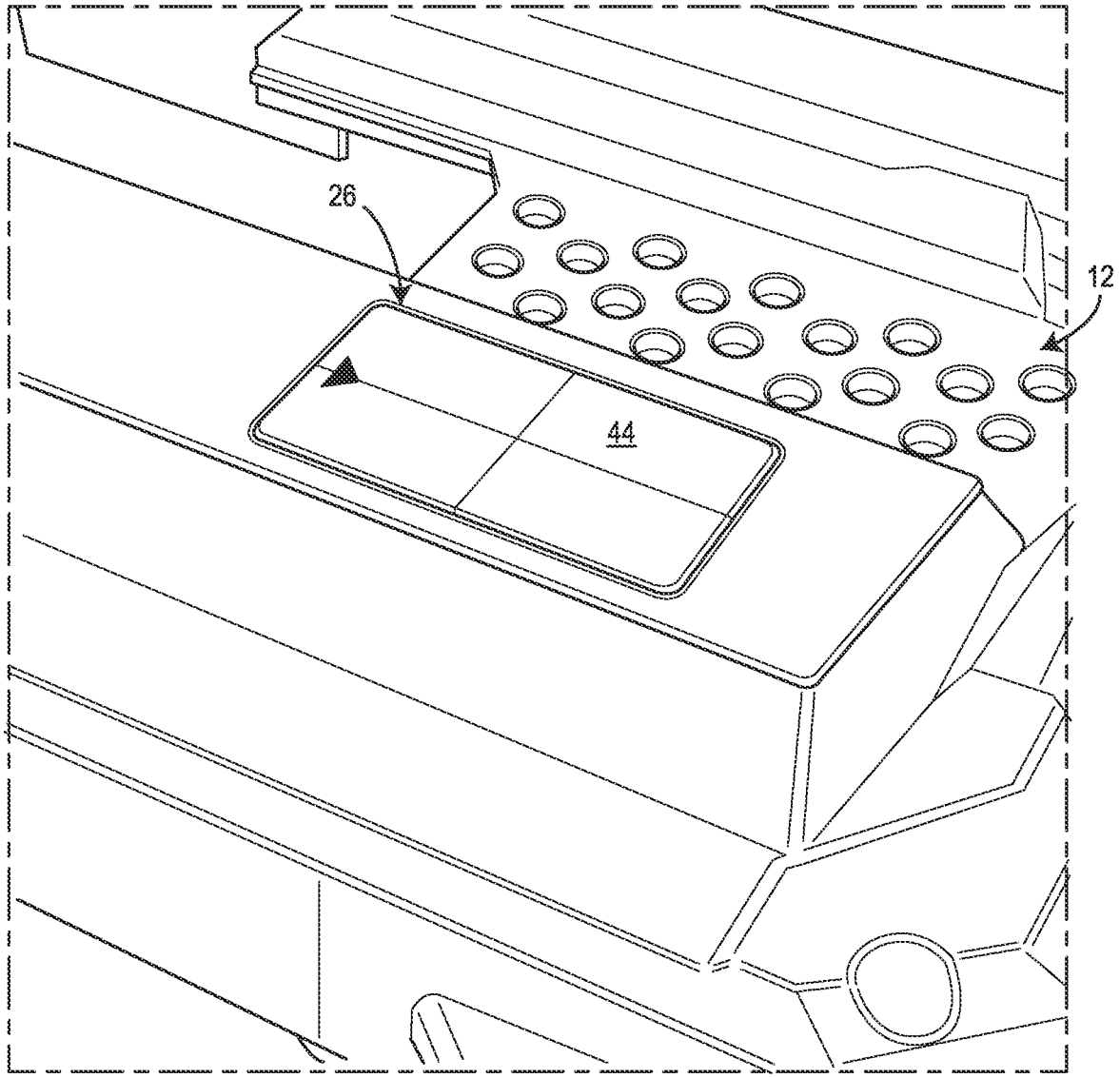
FIG. 14 is a schematic illustration showing a packaging locking assembly in the second position in accordance with the disclosure.

The receiving element 28 can be formed in, be comprised of structures disposed in and/or include structures attached to the product 12. For example, the receiving element 28 can be formed into or as a part of the product 12. FIG. 4 illustrates a receiving element 28, which is formed into a product (not shown). FIG. 7 illustrates a locking element 26 inserted into a receiving element 28 formed as part of the product 12. FIG. 11 is a partial view showing the receiving element 28 as including both a portion formed into or as part of the product and a receiving element retainer inserted into the product that engages with the locking element 26. In particular, the product includes an aperture 54 for receiving the locking element 26. The aperture 54 terminates in a receiving element retainer 88 that further include openings for receiving portions of the locking element 26. The first retaining structure 90 can be formed by projections of the product that extend into the aperture 54 and/or portions of the receiving element retainer 88. The second retaining structure 92 can be formed by projections or walls of the receiving element retainer 88 as detailed herein. The receiving element 28 includes an aperture 56 that has a first end 58 and inwardly disposed second end 60. In the arrangement of FIG. 11, the aperture 56 is formed in the product and terminates at the second end 60 in the receiving element retainer. The first end 58 is at or adjacent to the exterior surface 14 of the product 12. For example, in embodiments in which the receiving element 28 is formed as part of the product 12, the surface surrounding the first end 58 of the aperture 56 is the exterior surface 14 of the product 12. The receiving element 28 including a receiving element retainer can similarly include a surface that surrounds the first end 58 of the aperture 56 that is the exterior surface 14 of the product 12. This can be beneficial in hiding or incorporating the locking element as part of the product after the product 12 is removed from the package. An example of such hiding or incorporation of the locking element is shown in FIG. 14.

The aperture 56 can have a diameter that narrows from the first end 58 to the second end 60. Referring again to FIG. 4, the aperture can have two portions in embodiments. A first portion 62 can be disposed near the first end 58 and the second portion 64 can be inwardly disposed of the first portion 62 towards the second end 60. The first portion 62 can have a diameter that is wider than the diameter of the second portion 64. In embodiments, as illustrated in FIG. 4, as step or shoulder can be defined between the first and second portions 62, 64. In embodiments, the second portion 64 can have a tapered shape, narrowing in diameter as second portion 64 extends inwardly toward the second end 60. The first portion 62 can also be tapered in embodiments.

In still further embodiments, the aperture 56 can have a taper diameter that reduces as the aperture extends inwardly from the first end 58 to the second end 60, without the presence of a step or shoulder as illustrated in FIG. 4. In any of the tapered diameter apertures 56 herein, the second end 58 of the aperture 56 has a diameter that is sized such that the projections 50, 52 cannot be pulled back through the second end 58 after insertion through the second end 60. The aperture is arranged such that an open space or chamber is provided on an opposed side of the second end, thereby allowing the extended portion to extend into the chamber so the first or second projection can engaged the surface around the second end 60 after being passed thereto to prevent removal of the locking element. In embodiments, the receiving element 28 can be formed in a product that has a hollow interior, the second end 60 of the aperture terminating at the hollow interior into which the extended portion can be disposed when the first or second projection 50 is passed through the second end 60. The arrangement of first and second projections 50, 52 and their inability to be removed through the second end 60 of the aperture 56 after insertion provides the two stage, one-way insertion of the locking element 26 in the receiving element 28.

Referring to FIGS. 11-15, the aperture 56 can have a substantially uniform diameter and can terminate in the receiving element retainer 88, which then receives the second end 34 of the extended portion as opposed to allowing the second end 34 to pass through the aperture 56. In the arrangement of FIG. 11 (and further illustrated in FIGS. 13A-13C), a packaging lock 66 can be included to retain the locking element in the first position. FIG. 12 illustrate the packaging lock 66 from an exterior view of the product display panel. In this position, locking element 26 resists being removed from the aperture by engagement of the projections of the locking element with a first retaining structure. The first retaining structure 90 can be, for example, an internal wall or projection of the product that extends into the aperture to engage with the projection. Referring to FIG. 11A, a space can be disposed between surfaces of the receiving element retainer 88 and an internal projection or wall of the product or the aperture 56 formed or inserted therein, in which the projections of the locking element 26 can reside when the locking element 26 is in the first position. Alternatively, the first retaining structure 90 can be provided by a projection or wall of the receiving element retainer as opposed to the product itself. The arrangement shown in FIG. 11A (and further shown in FIG. 12) utilizes a packaging lock 66 that resists the locking element 26 from being pushed further into the product without the package first being removed. As described in detail above, the packaging lock 66 is removed to withdraw the product from the product display panel and ultimately allow for the locking element to be pushed into the product to the second position.

Figure 15A:
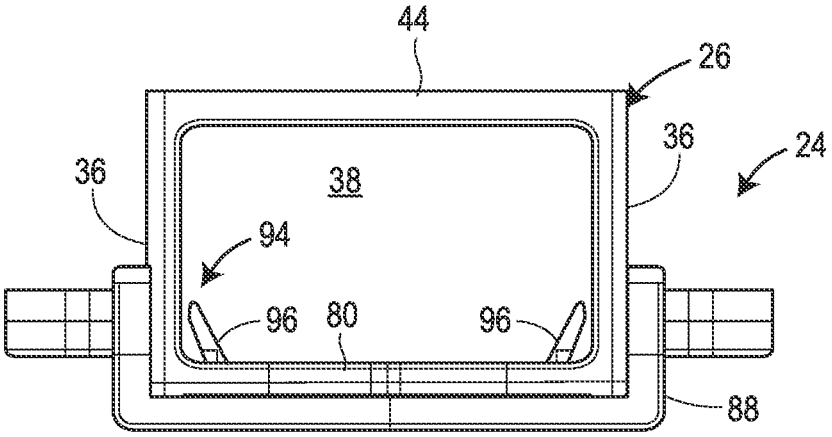
FIGS. 15A to 15C are views of a packaging locking assembly having a receiving element retainer in accordance with the disclosure, showing the locking element in the second position.
Figure 15B:
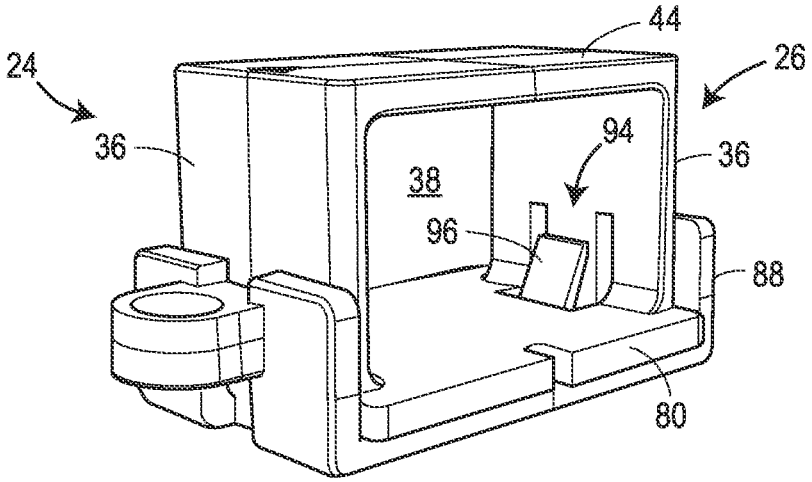
Figure 15C:
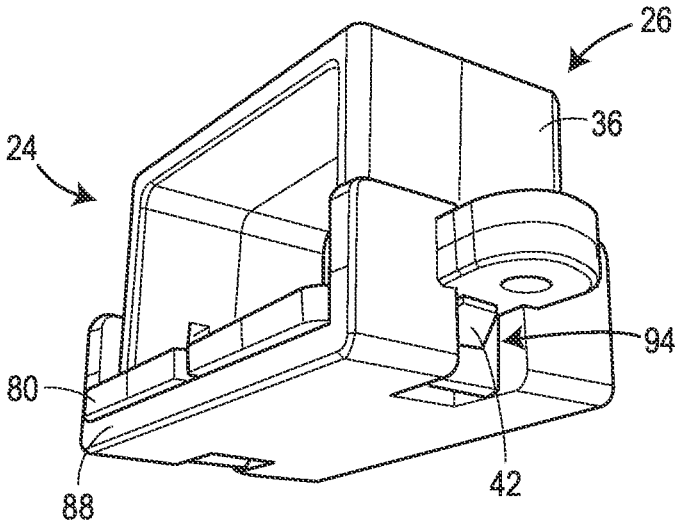

Referring to FIG. 11B and FIGS. 15A-15C, in configurations having a receiving element retainer 88, the locking element can engage with second retaining structure 92 when in the second position. The second retaining structure 92 can be, for example, a wall or projection of the receiving element retainer that engages with the projections 42 to prevent the locking element 26 from being withdrawn from the second position. For example, FIG. 11B illustrates a wall of the receiving element retainer 88 beneath which the projection 42 of the locking element 26 resides, such that if the locking element 26 were attempted to be withdrawn from the aperture 56, the projection 42 of the locking element 26 would abut the wall of the receiving element retainer 88 forming the first retaining structure 90. The receiving element retainer 88 can include a third retaining structure 94 in the form of locking extensions 96 that extend upwardly from a bottom surface of the receiving element retainer 88. Referring to FIG. 15A, when in the second position, the locking extensions 96 of the receiving element retainer can extend through apertures 82 in the connecting wall 80 of the locking element 26 and apply a force outwardly against the arms 36 of the locking element 26. FIG. 15B illustrates the interaction between the third retaining structure 94 and the locking element 26.

As described above and detailed further below, the extended portion 30 and/or the projections can be reversibly deformable to a reduced diameter during insertion to allow the projections 50, 52 to extend through the second end 60 of the aperture 56. The extended portion and/or the projections can then return to their original diameter after insertion through the second end 60. Once inserted through the second end 60, the projections 50, 52 can resist deformation or prevent deformation of the extended portion 30 when a force in the opposite direction of insertion, that is in the direction of removal of the locking element 26 thereby allowing the projections 50, 52 to prevent removal of the locking element 26 from the receiving element 28 after insertion.

For example, in embodiments in which the projections are formed of a reversible deformable material, the projections can be tapered such that the diameter increases along the length of the extended portion 30 from the second end 35 to the first end 32. Such a taper can aid in guiding deformation of the projection 50, 52 along the taper direction during insertion. However, after the projection 50, 52 is extended through the second end 60 of the aperture 56 of the receiving element 28, the wider diameter portion of the taper and direction of the taper can prevent deformation of the projection when a removal force in a direction opposite to insertion is applied.

In embodiments, the first portion can have a diameter and depth sized to receive the base 44 of the extended portion 30 such that the base 44 has an exterior surface 46 that is in substantially the same plane as the surface surrounding the aperture 56. The surface surrounding the aperture 56 can be, for example, the exterior surface 14 of the product 12.

In operation, the locking assembly 24 of the disclosure prevents the package from being removed from the product display panel 16 until either the product display panel is torn or otherwise modified to make the opening 18 larger, or the packaging lock 66 is removed, and the product display panel 16 is removed. After removal of the product display panel 16 from the product 12, the locking assembly 24 can be further adapted to have the locking element 26 be received into the receiving element 28. In embodiments, for example, where the receiving element 28 is part of the product 12, the locking element 26 can be further received into the receiving element 28 such that the base 44 of the locking element become substantially planar with the exterior surface 14 of the product 12 and the locking element becomes part of the product 12 and is substantially indiscernible from the exterior surface 14 of the product 12.

Referring to FIGS. 1 and 6, the locking element 26 can be adapted to be inserted into the receiving element 28 to a first position in which the first projection 50 is extended past the second end 60 of the aperture 56 of the receiving element 28. FIGS. 1 and 3 (item 3) illustrate the first position of the locking element 26. In the first position, the first projection 50 extend outwardly from the second end 60 of the aperture 56 and engages an surface surrounding the second end 60 to prevent the locking element 26 from being removed from the receiving element 28.

As described above, the extended portion 30 can be reversible deformable such that it can be deformed to the second diameter for insertion through the aperture 56 and then return to the original first diameter once the first projection 50 is extended through the second end 60. To allow for such reversible deformation within the aperture 56, the first and second projections 50, 52 are spaced along the length the extended portion 60 and the aperture 56 is sized and tapered or stepped, such that the second projection 52 resides in a portion of the aperture 56 having a diameter larger than the first diameter of the extended portion 30 including the second projection 52 when the first projection 50 is extended through the second end 60 of the aperture 56. For example, as illustrated in FIG. 1, the second projection 50 can be disposed in the first portion 62 of the aperture 56, which is wider than the diameter of the extended portion 30 including the second projection 52 and any gap 38, thereby allowing the extended portion 30 to return to the first diameter after insertion of the first projection 50 through the second end 60.

Referring to FIG. 1, in embodiments the product display panel 16 can be disposed between the receiving element 28 exterior surface, for example, the exterior surface 14 of the product 12, and the locking element 26. In such embodiments, the base 44 can be provided as locking peg 48 that has a diameter larger than the diameter of the opening 18 and cannot be passed through the opening 18 without tearing or otherwise damaging the product display panel 16. In such embodiments, a portion of the product display panel 16 is positioned between the locking peg 48 and the receiving element 28 exterior surface, which prevents the locking element 26 from being further inserted into the receiving element 28 to the second position.

In such embodiments in which the locking element 26 includes the locking peg 48 and opening 18 sized to prevent the locking peg 48 from passing there-through, the product display panel 16 can include one or more lines of reduced strength 70 for enlarging the opening 18 for removal of the product display panel 16 around the locking peg 48 when opening the package to remove the product 12. The one or more lines of reduced strength can be of any known type or form including tear lines, perforations, weakened portions, and the like. The product display panel 16 can further include indicia printed thereon to direct a consumer where to tear the product display panel 16 for removal of the product 12.

In other embodiments, as illustrated in FIG. 7, the opening 18 in the product display panel 16 can be sized such that the locking element 26 including the base 44 can be inserted and removed through the opening 18 without damage to the product display panel 16. In such embodiments, the packaging lock 66 is inserted into the packaging lock receiving aperture 54 of the locking element 26 to secure the product 12 on the product display panel 16. The packaging lock 66 extends beyond the bounds of the opening 18 in the product display panel 16 to prevent the locking element from being pulled through the opening. The packaging lock 66 arrangement also prevents the locking element 26 from being further inserted into the receiving element 28 to the second position when the packaging lock 66 is in the packaging lock receiving aperture 54. Removal of the product 12 from the product display panel 16 can be accomplished by removing the packaging lock 66 from the packaging lock receiving aperture 54 and then simply sliding the opening 18 of the product display panel 16 over the locking element 26.

Figure 2:
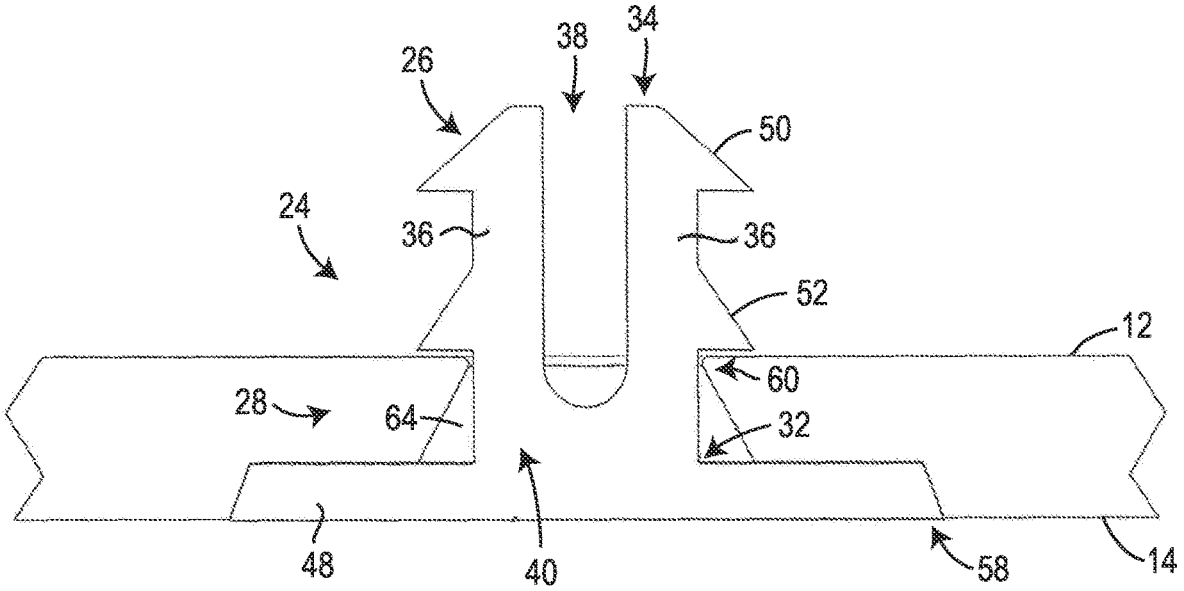
FIG. 2 is a cross-sectional side view of the package of FIG. 1, with the locking assembly being in a second position.
Figure 8:
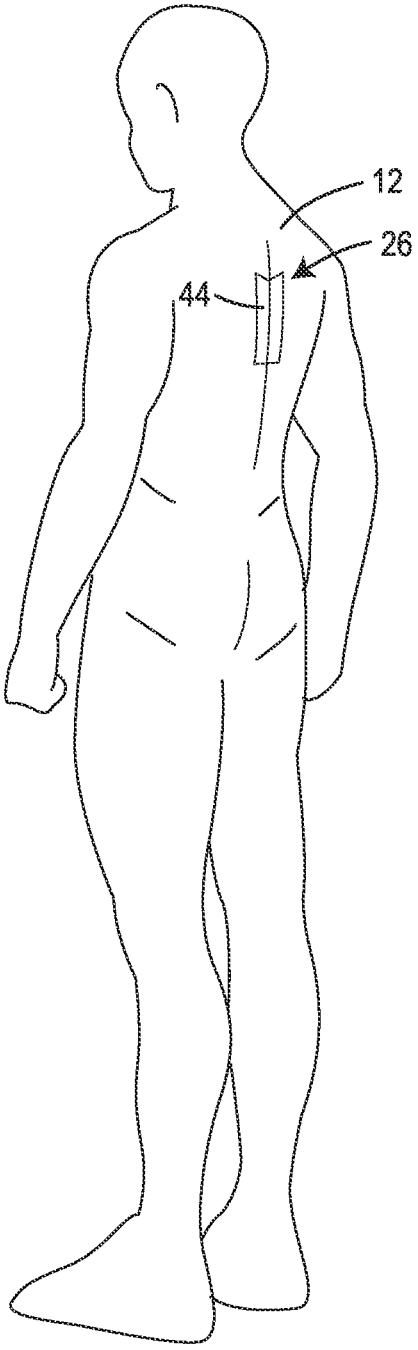
FIG. 8 is a schematic illustration of the package locking assembly of FIG. 5 after removal of the product from the package and insertion of the locking element to the second position.

Referring to FIGS. 2 and 5, once the product display panel 16 is removed from against the product, the locking element 26 can be shifted to the second position. In the second position, the locking element 26 is further inserted into the receiving element 28. Referring to FIGS. 1 and 6, in some arrangements, in the second position, the second projection 52 extends past the second end 60 and prevents the locking element 26 from being pulled back through the second end 60. In embodiments, such as illustrated in FIGS. 2 and 8, the receiving element aperture 56 can be sized at the first end 58 to entirely receive the base 44 of the locking element 26 such that it is substantially in the same plane as the exterior surface surrounding the receiving element aperture 56. In other arrangements, such as illustrated in FIGS. 11 and 15A-15C, the receiving element 28 can include a receiving element retainer 88, which has a second retaining structure 92 that engages the locking element while in the second position and has regions for receiving the locking element 26 such that the base 44 can be pushed flush with the exterior surface of the product surrounding the aperture 56 such that it is substantially in the same plane as the exterior surface (FIG. 14).

As illustrated in FIGS. 8 and 14, the exterior surface surrounding the receiving element aperture 56 can be the exterior surface 14 of the product 12, and insertion of the locking element 26 to the second position can allow the locking element 26 to become part of the product 12. The exterior surface 48 of the peg 44 (or locking peg 48) of the locking element 26 can be shaped, patterned, textured, or otherwise modified so that it has the same appearance as the exterior surface 14 of the product 12, making the locking element 26 blend into the exterior 14 of the product 12 when in the second position.

Figure 9A:
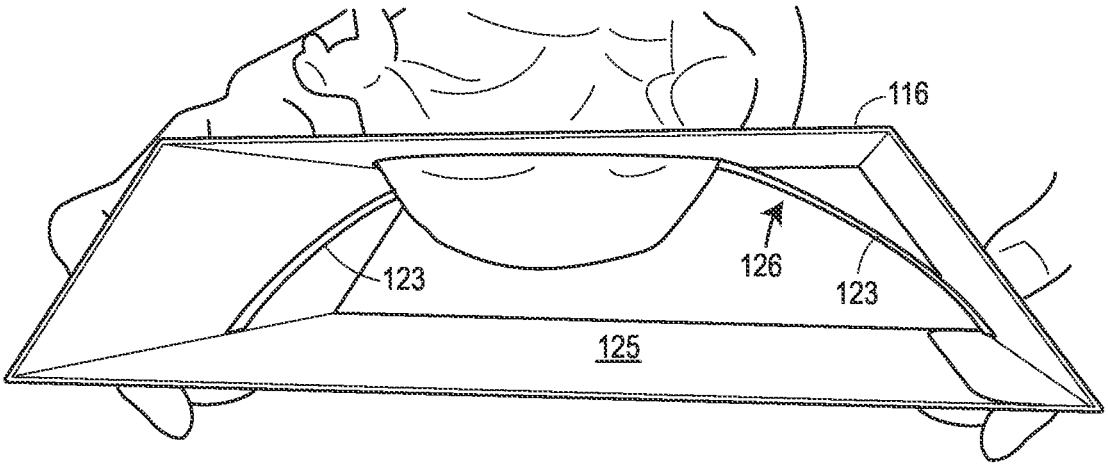
FIGS. 9A and 9B are schematic illustrations of a packaging locking assembly in accordance with the disclosure.
Figure 9B:
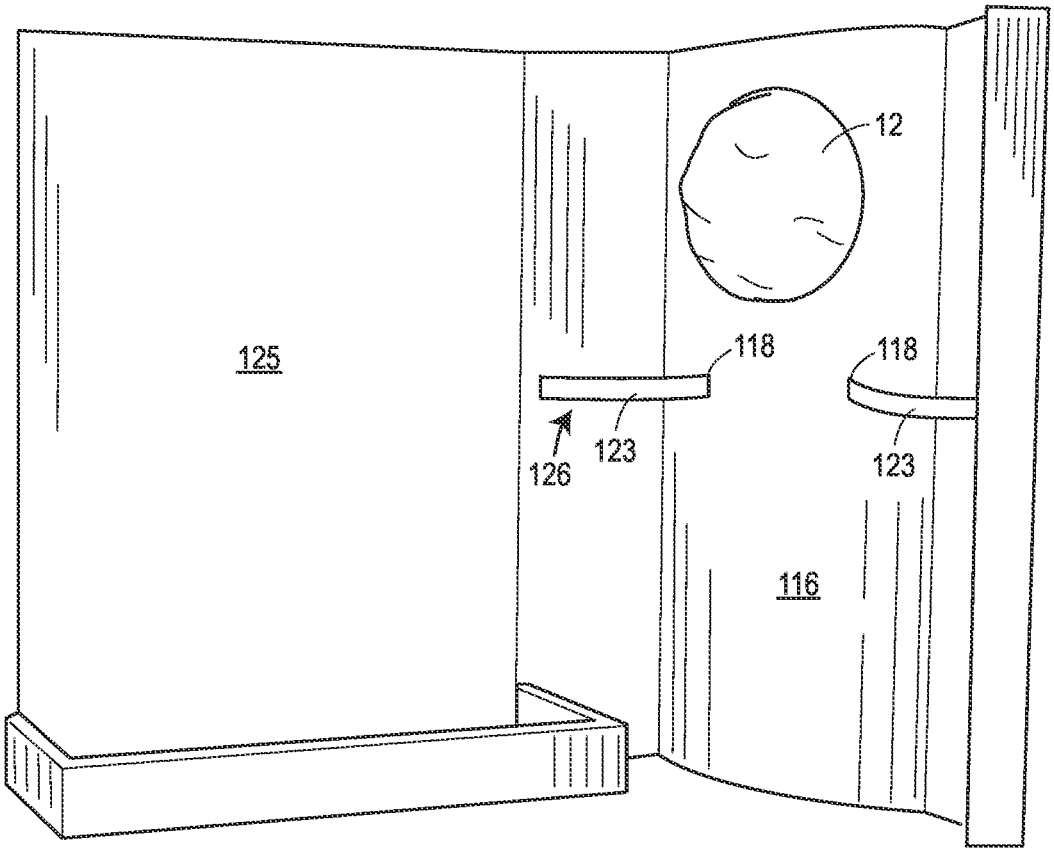

Referring to FIGS. 9A and 9B, a further packaging assembly of the disclosure is illustrated. In the embodiment of FIG. 9, the product display panel 116 includes a pair of openings 118. The product 112 includes a pair of openings 119 connected by a channel (not shown) on the interior of the package through which a locking element 126 can pass. The locking element 126 is in the form an elongated element that has sufficient length to pass through the pair of openings 119 and reside in the channel, with ends 123 of the locking element 126 extending external to the product 112 past the respective opening 119. The ends 123 of the locking element 126 are then passed through a respective opening 118 of the product display panel 116 so that the ends 123 reside on an opposed side of the product display panel 116 as the product 112, referred to herein for convenience as the back side. The package further includes another panel 125 either integral with or separate from the product display panel 116 that covers the locking element 126 on the back side of the product display panel 116 as the product 112. In embodiments, such as shown in FIG. 9, the panel 125 can place tension on the locking element 126, bending the locking element 126 to tension it, thereby locking the product 112 against the product display panel 116. Referring to FIG. 9B, during opening, the product 112 can be removed from the package by exposing the locking element 126 on the back side of the product display panel 116, and sliding the locking element 126 to remove it from the openings 119 and channel in the product. In other embodiments, the tensioning of the locking element 126 can be provided by the distance between the openings in the product or by the product display panel 116, with the additional panel 125 being present to cover the locking element 126 so it is not accessible until the packaging is opened. This can provide tamper evidence and prevent theft of the product when on store shelves, as removal of the product would require visible destruction of the package to access the locking element 126.

Figure 10A:
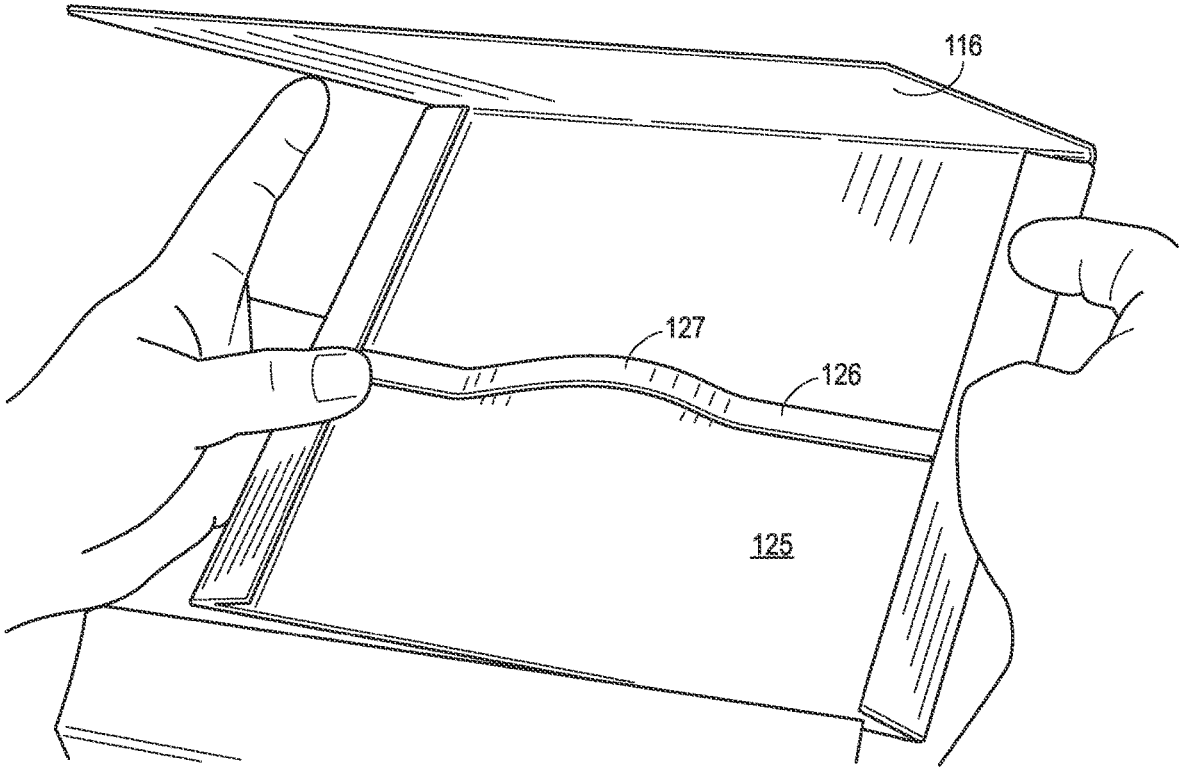
FIGS. 10A-10D are schematic illustrations of a packaging locking assembly in accordance with the disclosure.
Figure 10B:
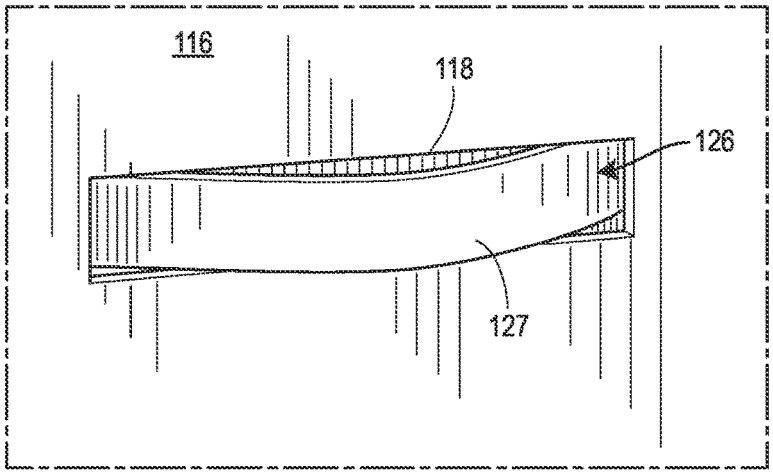
Figure 10C:
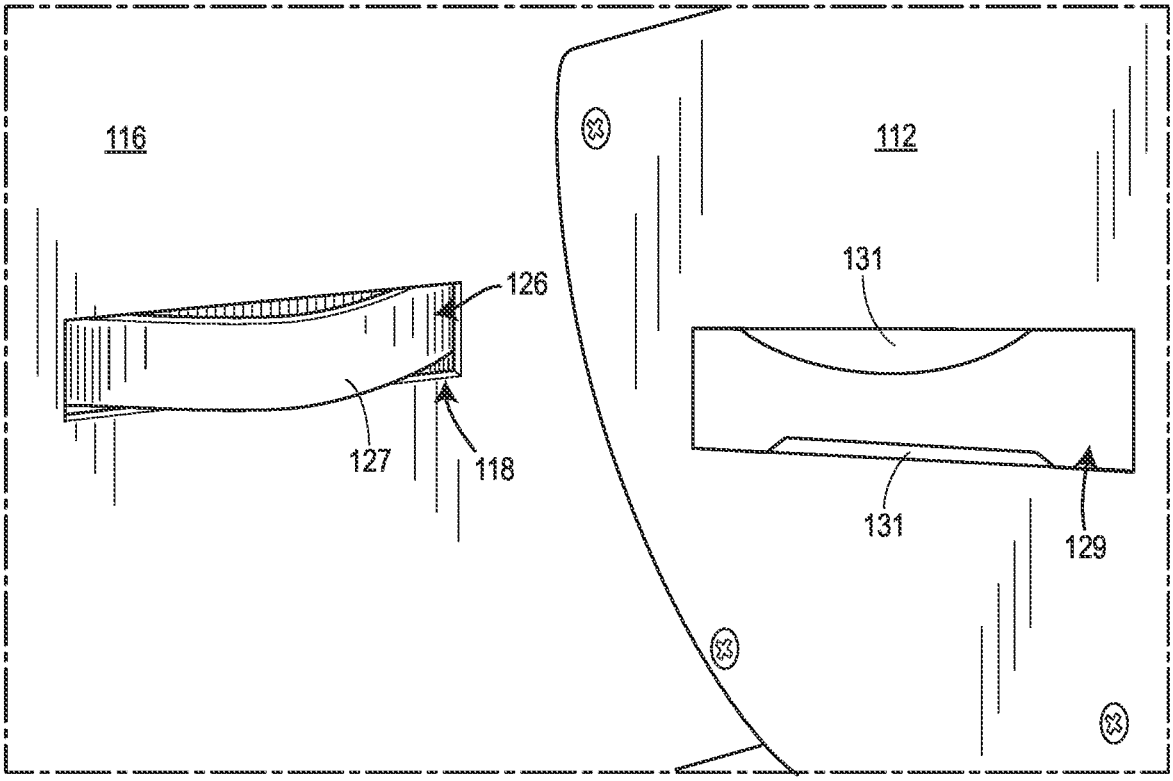
Figure 10D:
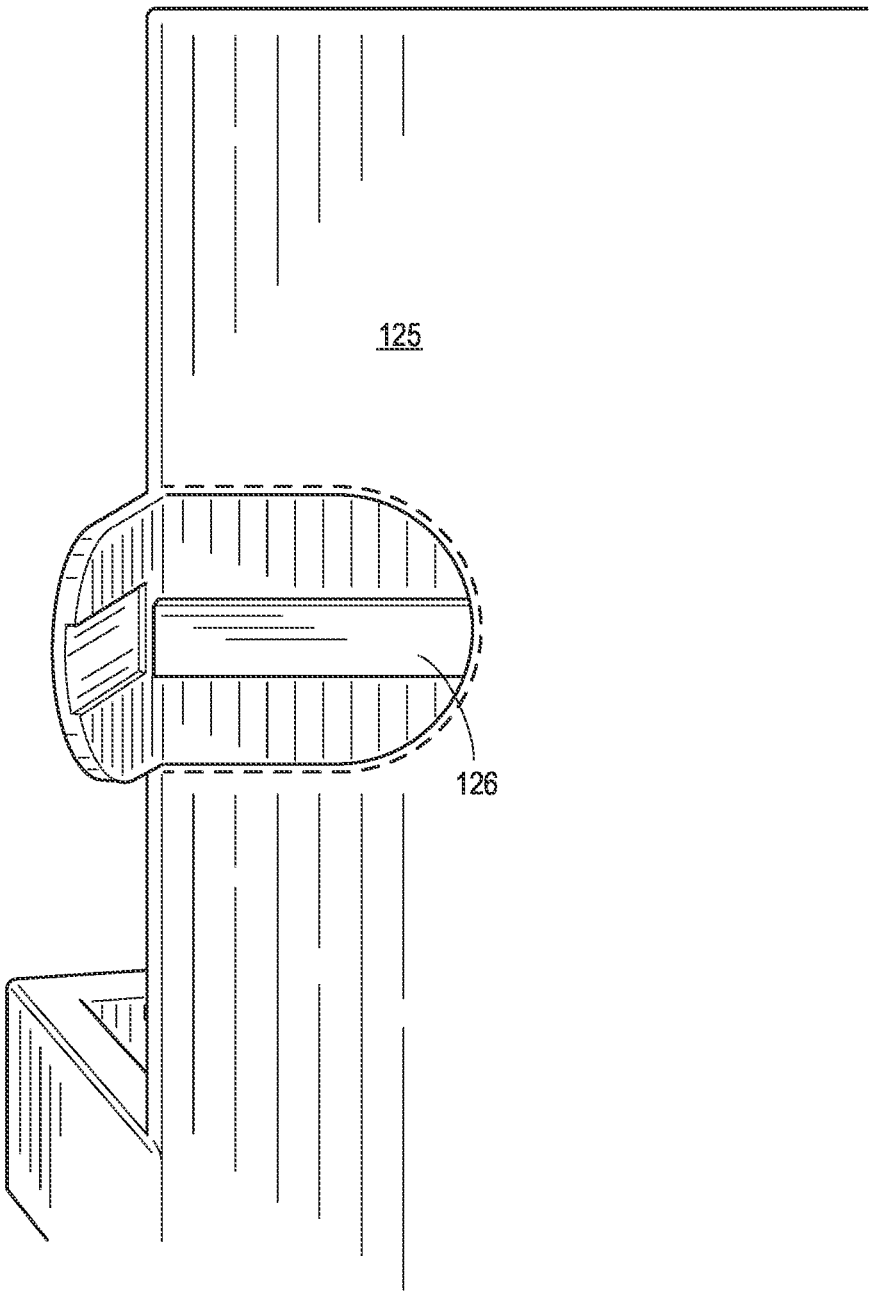

Referring to FIGS. 10A-10D, in still a further embodiment, a rigid locking element can be locked between a panel 125 and the product display panel 116. The product display panel can having an opening 118 through which a portion of the locking element 126 can extend. In the embodiment illustrated in FIG. 10B, for example, the locking element 126 can have a bow 127 the allows that portion of the locking element to extend past the opening on the product display panel 116, while the remaining ends of the locking element 126 remain flush against the panel 125, thereby allowing the closing of the product display panel 126 over the panel 125 to secure the locking element 126 in place. A product 112 can be provided with a locking receiving element 128 that can receive the portion of the locking element 126 extending through the opening 118 in the product display panel 126. The locking receiving element 128 can be adapted so that it can be snap or otherwise pushed to secure to the locking element 126, but once attached cannot be removed from the locking element 126 by pulling away from the locking element 126. For example, as illustrated in FIG. 10C, the locking receiving element 126 can include two tabs 131 that extend only in one direction to lock the locking element 126 in place and prevent it from being pulled out, and allowing it only to be slid out of the locking receiving element 128. Referring to FIG. 10D, to open the product 112, the packaging is opened to expose an end of the locking element 126, which can be grasped to slide the locking element 126 out from the packaging, thereby sliding out of the locking receiving element 129 of the product 112 and releasing the product 112 from the product display panel 116.

In addition, use of the "a" or "an" are employed to describe elements and components of the embodiments herein. This is done merely for convenience and to give a general sense of the description. This description should be read to include one or at least one and the singular also includes the plural unless it is obvious that it is meant otherwise.

One of ordinary skill in the art will readily recognize from the following discussion that alternative embodiments of the structures and methods illustrated herein may be employed without departing from the principles described herein.

Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the apparatus disclosed herein without departing from the spirit and scope defined in the appended claims.

What is claimed is:

1. A package, comprising:

a product display panel to which a product is to be secured, the product display panel comprising at least one opening for receiving a product locking assembly;

the product locking assembly comprising:

a locking element comprising a base and an extended portion extending from the base and at least one projection extending outwardly from the extended portion; and a receiving element disposed in or attached to the product, the receiving element comprising an aperture having a first end and an inwardly disposed second end, wherein:

the extended portion of the locking element is adapted to fit through the opening in the product display panel and be inserted into the receiving element to a first position such that the product display panel is secured to the product and the at least one projection engages with a first retaining structure of the receiving element such that the locking element cannot be withdrawn from the receiving element, and the locking element is adapted to be further inserted into the aperture after removal of the product display panel from the product to a second position such that the at least one projection engages with a second retaining structure of the receiving element.

2. The package of claim 1, wherein the extended portion comprises first and second spaced apart arms.

3. The package of claim 2, wherein the first and second arms extend from opposed ends of the base, each of the first and second arms comprising a projection.

4. The package of claim 2, further comprising a connecting wall connecting the first and second arms at or adjacent to ends of the first and second arms opposite the base.

5. The package of claim 4, wherein the connecting wall comprises apertures, and the receiving element comprises a receiving element retainer comprising locking extensions extending upwardly from a bottom wall of the receiving element retainer, the locking extensions are adapted to extend through the apertures in the connecting wall and apply a retaining force against the first and second arms when the locking element is in the second position.

6. The package of claim 1, wherein the first retaining structure is an internal wall portion of the product, and the at least one projection extends into the receiving element past the internal wall portion of the product and is resisted from removal from the receiving element by engagement of the at least one projection with the internal wall portion of the product; and/or wherein the second retaining structure is an internal wall portion of the receiving element that projects inwardly into the aperture such that when in the second position, the at least projection extends into the receiving element past the internal wall portion of the receiving element and is resisted from removal form the receiving element by engagement of the at least one projection with the internal wall portion of the receiving element.

7. The package of claim 1, wherein the receiving element comprises a receiving element retainer comprising locking extensions extending upwardly from a bottom wall of the receiving element retainer, the locking extensions are adapted to engage with the extended portion of the locking element when the locking element is in the second position.

8. The package of claim 1, further comprising a packaging lock that is adapted to be inserted in an opening in the locking element beneath the base when the locking element is in the first position and to be removed from the opening to allow the locking element to be pushed to the second position.

9. The package of claim 1, wherein an exterior surface of the head of the locking element is substantially in the same plane as the exterior of the product when the locking element is in the second position.

10. The package of claim 1, wherein the first and second projections have a tapered shape tapering outward from the second end of the extended portion to the first end of the extended portion.

11. The package of claim 1, wherein the extended portion comprises two arms extending, the two arms being separated by a gap, the gap extending at least between the first and second projections, thereby allowing the extended portion to reversible deform by movement of the arms into the gap.

12. The package of claim 1, wherein the aperture has a first portion and an inwardly disposed second portion that terminates at the second end, the first portion having a diameter larger than a diameter of the second portion such that a step is disposed between the first and second portions.

13. A package, comprising:

a product display panel to which a product is to be secured, the product display panel comprising an opening for receiving a product locking assembly;

the product locking assembly comprising:

a locking element having a head and an extended portion extending from the head, and the extended portion comprising first and second spaced apart projections, and a receiving element disposed in or attached to the product, the receiving element comprising an aperture having a first end and an inwardly disposed second end, wherein:

the locking element is adapted to fit through the opening and be inserted into the receiving element to a first position such that product display panel is secured to the product and the first projection extends past the second end of the aperture of the receiving element and prevents the locking element from being removed from the aperture, and the locking element being further adapted to be further inserted into the aperture after removal of the product display panel from the product to a second position such that the second projection extends past the second end of the aperture of the receiving element, and the aperture is sized such that the head can fit within the aperture at the first end when the locking element is in the second position.

14. The package of claim 13, wherein the head is a locking head having a size such that the locking head does not fit through the opening, a portion of the product display panel is positioned between the locking head and the product when the locking element is in the first position and prevents the locking element from being further inserted to the second position, and the product display panel is removed from between the locking head and the product by tearing the product display panel to enlarge the opening such that the product display panel can be removed around the locking head, thereby allowing the locking element to be further inserted to the second position.

15. The package of claim 13, wherein the product locking assembly further comprises a packaging lock, wherein the locking element further includes a packaging lock receiving aperture adapted to receive a packaging lock when the locking element is inserted into the receiving element to the first position, the packaging lock being adapted to prevent the locking element from being inserted into the receiving element to the second position when disposed in the packaging lock receiving aperture, the locking element being adapted to fit through the opening of the product display panel when the packaging lock is removed from the packaging lock receiving aperture to allow for removal of the product display panel from the product and further insertion of the locking element to the second position.

16. A package, comprising:

a product display panel to which a product is secured, the product display panel comprising an opening for receiving a product locking assembly, the product locking assembly comprising:

a locking element having a head and an extended portion extended outwardly from the head from a first end to an oppositely disposed second end, the extended portion having a first projection disposed at or adjacent to the second end and a second projection disposed along a length of the extended portion between the first projection and the first end; and a receiving element disposed in the product, the receiving element having an aperture that extends from a first end at a product exterior surface to a second end in an interior of the product, the aperture has a diameter at the second end that is smaller than a diameter at the first end, wherein:

the extended portion is adapted to reversibly deform from a first diameter to a second diameter such that the extended portion, when in a deformed state, can be inserted through the end of the aperture, and after insertion through the second end of the aperture expand back to the first diameter, the locking element is adapted to be non-reversibly inserted into the receiving element to a first position to secure the product to the package display panel, wherein in the first position the first projection extends through the second end of the aperture and prevents the locking element from being removed from the receiving element, and the locking element is adapted to be further inserted into the aperture of the receiving element to a second position after removal of the product from the product display panel wherein in the second portion the second projection extends past the second end of the aperture.

17. The package of claim 16, wherein the aperture is sized such that the head can fit within the aperture at the first end when the locking element is in the second position.

18. The package of claim 16, wherein the product locking assembly further includes a packaging lock, and the locking element further comprises a packaging lock receiving aperture for receiving the packaging lock, the packaging lock is adapted to be inserted into the packaging lock receiving aperture when the locking element is in the first position and extend across the aperture of the receiving element to thereby secure the product to the product display panel and prevent the locking element from being further inserted into the receiving element to the second position, and the packaging lock is adapted to be removed from the aperture for removal of the product display panel from the product and further insertion of the locking element into the receiving element to the second position.

19. The package of claim 16, wherein the head is a locking head and the locking head is has a diameter larger than a diameter of the opening in the product display panel and is adapted to prevent removal of the product display panel from the product when the locking element is in the first position, and wherein a portion of the product display panel is positioned between the locking head and the product when the locking element is in the first position and prevents the locking element from being further inserted to the second position, and the product display panel is removed from between the locking head and the product by tearing the product display panel to enlarge the opening such that the product display panel can be removed around the locking head, thereby allowing the locking element to be further inserted to the second position.

20. The package of claim 16, further comprising an exterior packaging element into which the product display panel having the product secured thereto with the locking assembly is inserted.

21. A product locking assembly for securing a product to a package panel, comprising:

a receiving element comprising an aperture, the receiving element being disposed in or attached to the product and extending from a first end to an inwardly disposed second end, a locking element comprising a head and an extended portion extending from the head, the extended portion comprising first and second spaced apart projections, wherein:

the locking element is adapted to be non-reversibly inserted through an opening in the packaging panel and into the receiving element to a first position thereby securing the product to the package panel, and in the first position, the first projection extends past the second end of the aperture of the receiving element and prevents the locking element from being removed from the aperture, and the locking element being further adapted to be further inserted into the aperture of the receiving element to a second position after removal of the product from the packaging panel, and in the second position the second projection extends past the second end of the aperture of the receiving element, wherein the aperture is sized such that the head can fit within the aperture at the first end when the locking element is in the second position.

22. The product locking assembly of claim 21, wherein the extended portion is adapted to reversibly deform from a first dimeter to a second diameter such that the extended portion in a deformed state can be inserted through the second end of the aperture, and after insertion expand back to the first diameter.

23. The product locking assembly of claim 21, wherein head has a diameter larger than a diameter of the opening to thereby prevent the packaging panel from being removed from the product when the locking element is in the first position, and prevents the locking element from being further inserted to the second position.

24. The product locking assembly of claim 22, further comprising a packaging lock, wherein the locking element further comprises a packaging lock receiving aperture adapted to receive the packaging lock when the locking element is inserted into the receiving element to the first position, the packaging lock being adapted to secure the product to the packaging panel and prevent the locking element from being inserted into the receiving element to the second position when disposed in the packaging lock receiving aperture, the locking element including the head being adapted to fit through the opening of the product display panel when the packaging lock is removed from the packaging lock receiving aperture to allow for removal of the product display panel from the product and further insertion of the locking element to the second position.

25. The product locking assembly of claim 24, wherein the extended portion comprises two arms extending from the plate and separated by the aperture.

26. The product locking assembly of claim 25, wherein each of the two arms comprises inwardly extending legs at the second end reducing the diameter of the aperture at the second end.

* * * * *